US007025044B1

(12) United States Patent
Breeden et al.

(10) Patent No.: US 7,025,044 B1
(45) Date of Patent: Apr. 11, 2006

(54) PUMP ASSEMBLY AND METHOD

(75) Inventors: Robert H. Breeden, Wooster, OH (US); Peter H. Sheppard, Hanover, PA (US); Mark A. Sterrett, Spring Grove, PA (US)

(73) Assignee: R. H. Sheppard Co., Inc., Hanover, PA (US)

( * ) Notice: Subject to any disclaimer, the term of this patent is extended or adjusted under 35 U.S.C. 154(b) by 65 days.

(21) Appl. No.: 10/621,174

(22) Filed: Jul. 16, 2003

(51) Int. Cl.
*F02M 37/04* (2006.01)

(52) U.S. Cl. ..... 123/446; 123/459; 137/12

(58) Field of Classification Search ..... 123/446, 123/456, 467, 514, 459, 460; 251/63; 137/12, 137/505; 417/289, 490, 295
See application file for complete search history.

(56) References Cited

U.S. PATENT DOCUMENTS

| | | | | |
|---|---|---|---|---|
| 1,945,452 | A | 1/1934 | Sidney | 103/41 |
| 1,948,047 | A | 2/1934 | Retel | 103/37 |
| 1,947,851 | A | 9/1934 | Hurst | 103/42 |
| 2,101,226 | A | 12/1937 | Sonntag | 103/37 |
| 2,102,117 | A | 12/1937 | Goldberg | 103/37 |
| 2,281,302 | A | 4/1942 | Amery | 103/220 |
| 2,297,234 | A | 9/1942 | Meiswinkel | 103/41 |
| 2,357,870 | A | 9/1944 | Beeh | 103/41 |
| 2,394,285 | A | 2/1946 | Bevins | 103/182 |
| 2,440,194 | A | 4/1948 | Juhasz et al. | 103/41 |
| 2,594,132 | A | 4/1952 | Dalrymple | 137/153 |
| 2,657,631 | A | 11/1953 | Evans | 103/2 |
| 2,691,388 | A | 10/1954 | Livers | 137/505 |
| 2,732,805 | A | 1/1956 | Lucien | 103/42 |
| 3,096,716 | A | 7/1963 | Chmura | 103/37 |
| RE25,553 | E | 4/1964 | Budzich | 103/37 |
| 3,183,848 | A | 5/1965 | Raymond | 103/173 |
| 3,519,370 | A | 7/1970 | Bleuel | 103/5 |
| 3,771,889 | A | 11/1973 | Mason et al. | 60/473 |
| 3,771,917 | A | 11/1973 | Davies | 417/289 |
| 3,820,920 | A | 6/1974 | Klimmaszewski et al. | 417/213 |
| 3,834,838 | A | 9/1974 | Indra | 417/490 |
| 4,273,516 | A | 6/1981 | Farr | 417/214 |
| 4,366,747 | A | 1/1983 | Falendysz et al. | 92/72 |
| 4,371,317 | A | 2/1983 | Heibel | 417/298 |
| 4,431,381 | A | 2/1984 | Falendysz et al. | 417/289 |
| 4,462,566 | A * | 7/1984 | French | 251/129.1 |
| 4,558,631 | A * | 12/1985 | Fassbender | 91/516 |
| 4,741,675 | A | 5/1988 | Bowden | 417/295 |
| RE32,965 | E | 6/1989 | Schmid | 123/503 |
| 4,911,615 | A | 3/1990 | McCullagh | 417/295 |
| 5,181,494 | A | 1/1993 | Ausman | 123/446 |
| 5,485,820 | A | 1/1996 | Iwaszkiewicz | 123/446 |
| 5,515,829 | A | 5/1996 | Wear et al. | 123/446 |
| 5,881,698 | A | 3/1999 | Tuckey et al. | 123/497 |
| 5,957,111 | A | 9/1999 | Rodier | 123/446 |
| 5,957,674 | A | 9/1999 | Zenmei et al. | 417/505 |
| 5,996,556 | A | 12/1999 | Klinger et al. | 123/466 |
| 6,029,628 | A | 2/2000 | Oleksiewicz et al. | 123/446 |
| 6,135,090 | A | 10/2000 | Kawachi et al. | 123/446 |

(Continued)

*Primary Examiner*—Carl S. Miller
(74) *Attorney, Agent, or Firm*—Hooker & Habib, P.C.

(57) ABSTRACT

A pump assembly includes a high-pressure pump that flows pressurized working fluid in a fuel injection system of a diesel engine. The assembly includes a pilot-operated inlet throttle valve that receives a flow of low-pressure fluid from a feed pump and controls the volume of fluid flowed to the high-pressure pump in response to an electronic control module for the diesel engine. The operation of the inlet throttle valve is independent of fluctuations in output pressure from the feed pump.

45 Claims, 6 Drawing Sheets

U.S. PATENT DOCUMENTS

| | | | | |
|---|---|---|---|---|
| 6,142,747 | A | 11/2000 | Rosenau et al. | 417/251 |
| 6,149,073 | A | 11/2000 | Hickey et al. | 239/89 |
| 6,152,107 | A | 11/2000 | Barnes et al. | 123/357 |
| 6,170,508 | B1 | 1/2001 | Faust et al. | 137/12 |
| 6,216,670 | B1 | 4/2001 | Anderson et al. | 123/446 |
| 6,227,167 | B1 | 5/2001 | Smith et al. | 123/446 |
| 6,234,270 | B1 | 5/2001 | Bartley et al. | 180/417 |
| 6,293,253 | B1 | 9/2001 | Arnold et al. | 123/458 |
| 6,427,663 | B1 * | 8/2002 | Breeden | 123/446 |
| 6,460,510 | B1 * | 10/2002 | Breeden | 123/446 |
| 6,564,776 | B1 | 5/2003 | Haeberer et al. | 123/456 |
| 6,647,965 | B1 * | 11/2003 | Breeden | 123/446 |
| 6,662,784 | B1 * | 12/2003 | Breeden | 123/446 |
| 6,668,801 | B1 * | 12/2003 | Smith et al. | 123/446 |
| 6,672,285 | B1 * | 1/2004 | Smith et al. | 123/446 |
| 6,755,625 | B1 * | 6/2004 | Breeden | 417/298 |
| 6,910,465 | B1 | 6/2005 | Trzmiel et al. | 123/498 |
| 2003/0077184 | A1 | 4/2003 | Ishimoto | 417/295 |
| 2003/0094158 | A1 | 5/2003 | Maier et al. | 123/447 |

* cited by examiner

PUMP ASSEMBLY AND METHOD

FIELD OF THE INVENTION

The invention relates to pump assemblies and pumping methods where the output of the pump assembly is controlled by throttling inlet flow to the pump. The pump assembly and method may be used to pressurize a working fluid in a fuel injection system for an internal combustion engine, such as a diesel engine.

DESCRIPTION OF THE PRIOR ART

Diesel engine fuel injection systems that use a high-pressure pump to pressurize a working fluid are well known. Examples of such fuel injection systems include hydraulic electronic unit injector systems (referred herein as "hydraulic injector systems") and common rail systems.

In a hydraulic injector system the pump pressurizes a working fluid, typically engine lube oil, and the oil is flowed at high pressure to fuel injectors. The hydraulic energy in the oil actuates the injectors, which inject fuel at high pressure into the engine cylinders. In a common rail system, the pump pressurizes engine fuel and the fuel is flowed at high pressure to a pressurized passage commonly called a common rail. The rail supplies fuel to the fuel injectors. The fuel pressure in some common rail systems is sufficiently high that fuel can flow directly into the engine cylinders without further pressurization by the fuel injectors.

The desired instantaneous pressure of the pressurized oil or fuel varies with the operating conditions of the engine. Hydraulic injector systems and common rail fuel injection systems regulate fluid pressure by varying the flow of fluid discharged from the high-pressure pump. An electronic control module determines the pressure required for optimum engine performance and increases or decreases the pump output as needed to achieve the desired pressure.

Some fuel injection systems use a variable displacement high-pressure pump to vary pump output. Variable displacement pumps are expensive and mechanically complex. Other fuel injection systems use a fixed displacement high-pressure pump and control the flow of working fluid to the pump to vary pump output. This enables use of a less complex, less expensive pump in the fuel injection system.

Co-inventor Robert H. Breeden's U.S. Pat. No. 6,460,510 discloses a pump assembly for a fuel injection system that uses an inlet throttle valve to control the flow of working fluid to a fixed displacement high-pressure pump. The inlet throttle valve includes a movable spool that varies the flow of fluid through the valve. The engine control module controls the position of the spool to achieve the desired output from the pump.

Although the Breeden pump assembly has many advantages over other pump assemblies used in fuel injection systems, there is room for improvement. The inlet throttle valve is supplied fluid at low pressure from a feed pump. Pressure fluctuations in the fluid supplied by the feed pump can affect the operating position of the spool and reduce engine efficiency. These fluctuations can be caused by changes in engine speed or by changes in fluid temperature or viscosity.

It is desirable to modify the Breeden pump assembly such that spool position is not affected by pressure fluctuations in the working fluid supplied by the feed pump. This will prevent changes in the pressure of the low pressure fluid from directly affecting throttle spool position and decreasing engine efficiency.

SUMMARY OF THE INVENTION

The invention is an improved inlet throttle valve assembly for a high-pressure pump, particular a high-pressure pump of the type disclosed in U.S. Pat. No. 6,460,510, in which an inlet throttle valve controls the flow of working fluid to a fixed displacement high-pressure pump. The inlet throttle valve has a movable piston to increase or decrease the flow of fluid through the valve. Piston position is not affected by pressure fluctuations in the working fluid flowing through the inlet throttle valve.

The improved pump assembly can be used in hydraulic injector systems or common rail fuel injection systems pumping engine lube oil or engine fuel. Engine efficiency and fuel economy increase, and engine exhaust emissions decrease.

An inlet throttle valve assembly in accordance with the present invention includes a body and an inlet throttle valve in the body. An inlet passage flows working fluid to the inlet throttle valve and an outlet passage discharges working fluid from the inlet throttle valve to the pump. A fluid circuit communicates a pilot fluid to the inlet throttle valve and selectively operates the valve in response to the pilot fluid pressure.

The inlet throttle valve includes a bore in the body, the bore having axially spaced first and second ends, and a wall extending between the ends. A hollow piston slideable in the bore controls the flow of fluid through the valve. The inlet passage includes a first opening in the bore wall and the outlet passage includes a second opening in the bore wall.

A chamber is in the bore between the piston and the first end of the bore, and a spring biases the spool towards the chamber. The fluid circuit opens into the chamber and is configured to flow pilot fluid into and out of the chamber for controlling the position of the spool along the bore.

The piston has axially opposed closed ends and an outer surface surrounding the interior of the piston. A flow passage extends through the interior of the piston between the ends of the piston. The flow passage flows fluid between the first and second wall openings to flow working fluid through the inlet throttle valve. The position of the piston along the bore is established by a pressure balance between the spring and the pilot pressure in the chamber and is substantially unaffected by pressure fluctuations in the fluid flowing through the valve.

During operation the engine control module generates a signal representing the desired instantaneous pressure, hence flow rate, of the high-pressure pump. The piston is moved in response to the signal by flowing pilot fluid into or out of the chamber to close or open the flow passage and thereby control the flow of working fluid from the inlet throttle valve to the pump.

The pressure of the fluid flowing through the piston has no substantial impact on the equilibrium position of the spool. The piston acts as a pressure vessel whose internal surfaces oppose fluid pressure. The fluid pressure acting on the piston applies no substantial net axial force on the piston because the forces acting on the closed ends of the spool are essentially equal in magnitude but opposite in direction. The axial forces balance and cancel each other out. Pressure fluctuations do not affect the axial position of the piston along the bore.

In a preferred embodiment of the present invention the hollow piston is a spool having closed ends and a cylindrical wall extending between the ends and surrounding the interior of the spool. The spool divides the bore into the first chamber adjacent the first end of the bore and a second chamber adjacent the second end of the bore. The spring is captured within the second chamber and urges the spool towards the first end of the bore. The second chamber is vented to a constant pressure source, such as the sump or fuel tank providing the source of the working fluid, so that the pressure within the second chamber is constant and does not change with the position of the spool along the bore.

The spool flow passage has inlet and oulet openings that extend through the wall to the interior of the piston. The inlet and outlet openings are axially spaced from each other and are configured to minimize unbalanced loading and friction of the spool against the bore. Working fluid flows through the inlet opening, through the interior of the spool, and through the discharge opening. The openings are sized and positioned to smoothly open and close the flow passage with movement of the spool along the bore.

The inlet throttle valve assembly of the present invention accommodates a feed pump whose output pressure varies with engine speed and changes in fluid temperature or viscosity. The engine control module does not have to respond to changes in spool position caused by fluctuations in fluid pressure to the inlet throttle valve. The accuracy and performance of the pump assembly when responding to the engine control module is increased for improved engine efficiency, increased fuel mileage, and reduced emissions.

Other objects and features of the invention will become apparent as the description proceeds, especially when taken in conjunction with the accompanying six sheets of drawings illustrating two embodiments of the invention.

DESCRIPTION OF THE PREFERRED EMBODIMENTS

Figure 1:
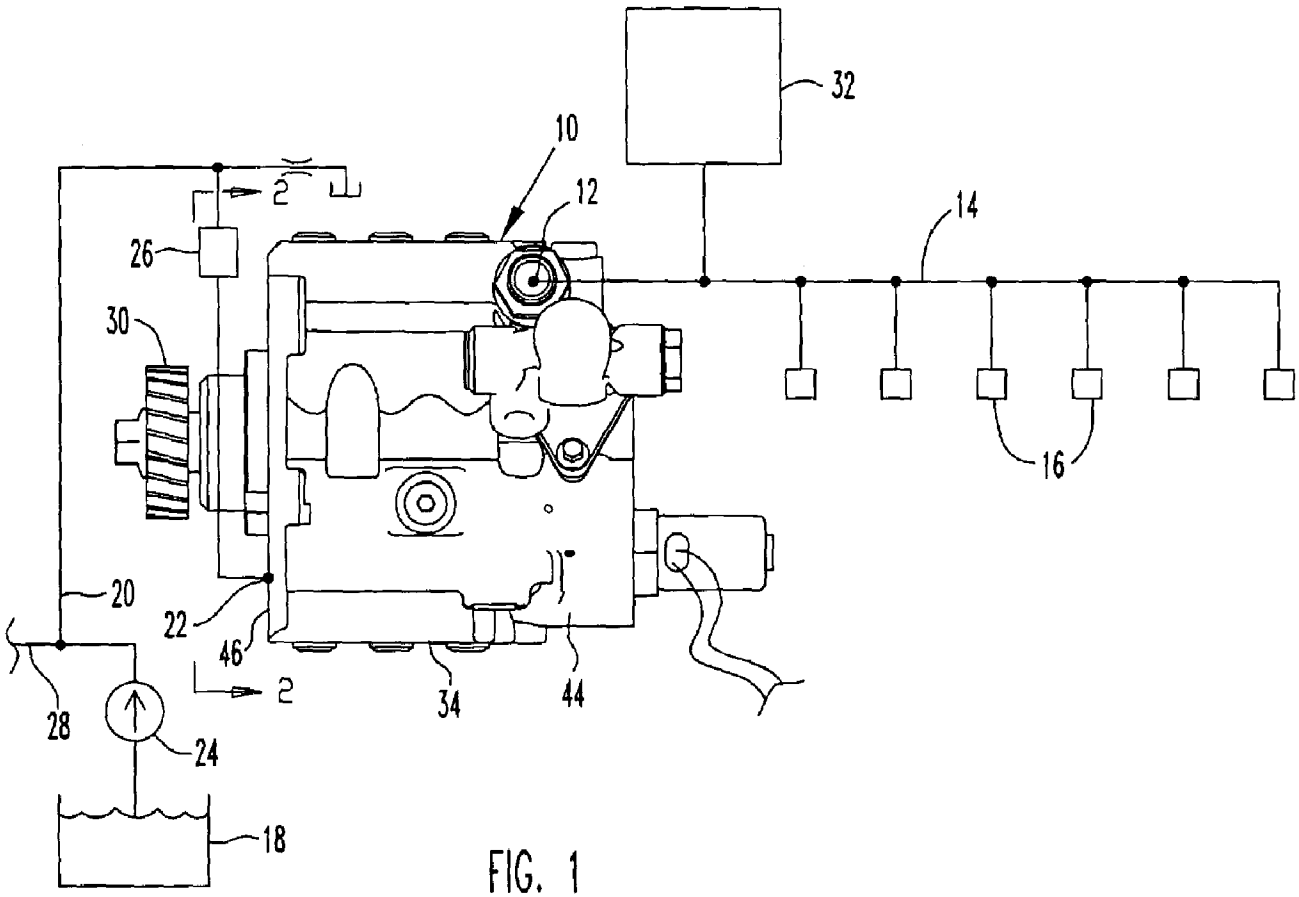
FIG. 1 is a representational view illustrating a first embodiment pump assembly mounted on a diesel engine to actuate hydraulically-actuated fuel injectors.
Figure 2:
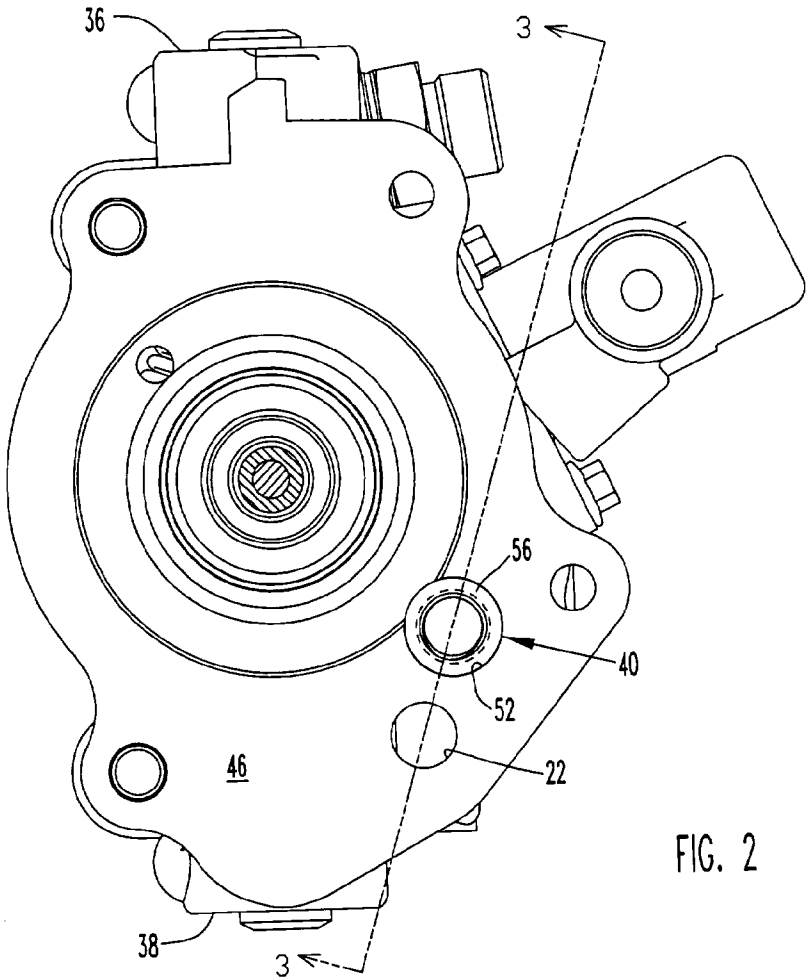
FIG. 2 is a view taken along lines 2—2 of FIG. 1.

FIGS. 1–7 show a first embodiment inlet throttle controlled pump assembly 10 mounted on an internal combustion engine, typically a diesel engine used to power a motor vehicle, to actuate hydraulically actuated fuel injectors. Co-inventor Robert H. Breeden's U.S. Pat. No. 6,460,510 discloses a diesel engine with a pump assembly for hydraulically actuated fuel injectors related to pump assembly 10. The disclosure of U.S. Pat. No. 6,460,510 is incorporated herein by reference in its entirety.

The pump assembly 10 discharges high pressure engine oil through outlet port 12 to a high-pressure outlet line 14 that flows the oil to solenoid-actuated fuel injectors 16. The pump assembly is supplied low pressure oil from a sump 18 through inlet line 20 connected to pump assembly inlet port 22. The inlet line 20 includes a low pressure oil pump 24 that draws oil from the sump and flows oil to a start reservoir 26 connected to the inlet port 22. The start reservoir 26 is above the pump assembly 10. The pump 24 also flows lubricating oil to engine bearings and cooling jets through line 28 that branches from line 20. Input gear 30 is connected to the pump assembly and is rotated by the engine to power the assembly.

High pressure compression chamber 32 is joined to line 14. The chamber may be external to the diesel engine. Outlet line 14 may also include an oil manifold attached to the diesel engine. Alternatively, the oil manifold may have sufficient volume to eliminate the need for an external chamber.

Pump assembly 10 includes a high-pressure pump 34 connected between inlet port 22 and outlet port 12. The pump 34 includes six high-pressure piston pumps arranged in two 180-degree banks 36, 38 of three piston pumps each, and is otherwise similar to the high-pressure pump disclosed in U.S. Pat. No. 6,460,510. Inlet port 22 flows low pressure oil to the pump 34. Outlet port 12 flows high pressure oil from the pump to high pressure line 14. A pilot-operated inlet throttle valve assembly 40 includes an inlet throttle valve 42 located in inlet port 22 that controls the flow of oil into the pump 34.

The pump assembly includes a cast iron body 44 bolted to the diesel engine that mounts the assembly to the engine against body mounting face 46, with input gear 30 meshed with a gear on the engine rotated by the engine crank shaft. Inlet port 22, outlet port 14, the pump pistons, and inlet throttle valve 42 are in the body 44. Inlet port 22 includes valve inlet passage 48 that extends into the body 44 from face 46 to the inlet throttle valve, and valve discharge passage 50 that extends from the inlet throttle valve to the pump 34.

Inlet throttle valve 42 includes a bore passage 52 surrounded by body wall 53 and a hollow piston or valve spool 54 that sealingly slides in the bore passage. Passage 52 extends through the body 44 from face 46 to the opposite side of the body. End plug 56 closes the inner end of the bore 52, and end plug 58 closes the outer end of the bore 52. The spool 54 has closed ends and divides the bore into a pair of chambers 60, 62 adjacent the ends of the spool. A vent passage 64 (see FIG. 7) communicates the chamber 60 with the sump 18 and maintains the chamber 60 at a substantially constant internal pressure during operation of the pump assembly.

Inlet throttle spring 66 is captured in the chamber 60 between the end plug 56 and the spool. The spring 66 urges the spool toward the outer end of the bore. A standoff or post 68 in the chamber 62 extends from the end plug 58 towards the spool. The inlet throttle valve assembly includes an injector pressure regulator valve (IPR valve) 70 that communicates pilot fluid to the valve through a control passage 72 opening into the chamber 62. The standoff 68 prevents the spool from closing control passage 72 and establishes the fully open position of the spool along the bore. A pilot drain port 73 extends from the valve outlet passage 50 and opens into the bore wall 53 to communicate the bore with the pump. This establishes the closed position of the spool 54 along the bore as is explained later below.

Spool 54 is formed from a tubular body 74 having a closed end 76 and a cylindrical outer wall 78 extending to the other end of the spool. End plug 80 closes the open end of the wall 78 and engages the standoff 68 to limit axial movement of the spool towards the outer end of the bore 52. Inlet flow opening 82 adjacent the end plug 80 and outlet flow opening 84 adjacent spool end 76 each extends through the wall 78 to the interior of the spool. Bleed line 86 extends from the interior of the spool and opens in an outer annular groove 88 formed on the outer wall 74 adjacent the spool end 76.

Valve inlet passage 48 is parallel with and spaced from the bore passage 52 and extends to an annular opening 90 in the bore wall 53. Valve outlet passage 50 includes an annular opening 92 in the wall 53. The openings 90, 92 are axially spaced from each other and are aligned with the spool flow openings 82, 84. The openings 90, 92 each surround the spool wall 78 at all times. Pilot drain port 73 is located between valve inlet passage 48 and the spool end 80.

Figure 6:
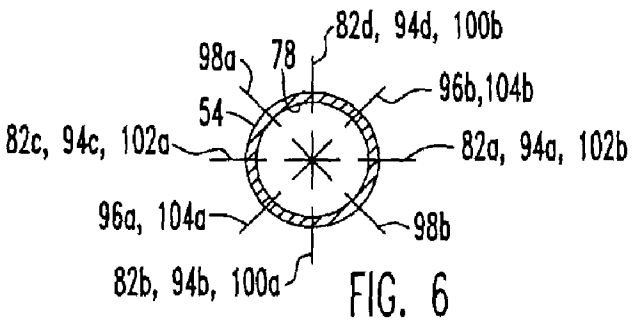
FIG. 6 is a sectional view taken along line 6—6 of FIG. 4 showing the circumferential locations of flow openings.
Figure 5:
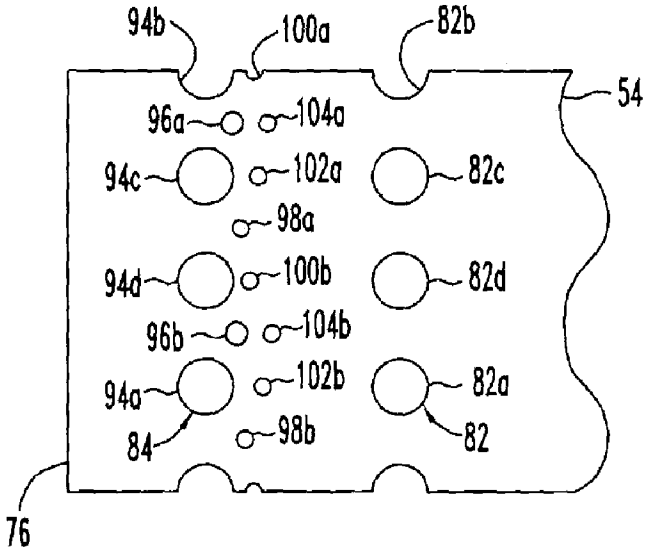
FIG. 5 is a view of the surface of the inlet throttle valve spool unwound.

As shown in FIGS. 5 and 6, spool inlet opening 82 includes four large-diameter inlet flow openings 82*a*, 82*b*, 82*c* and 82*d* spaced 90 degrees apart along the circumference of the wall 78.

Spool outlet opening 84 includes four large-diameter outlet flow openings 94*a*, 94*b*, 94*c* and 94*d*, also spaced 90 degrees apart. A pair of diametrically opposed intermediate-diameter outlet flow openings 96*a*, 96*b* are located midway between respective pairs of openings 94*b*, 94*c* and 94*d*, 94*a* but are shifted axially towards the flow opening 82 about one-half diameter of the large openings 94. Four pairs of diametrically opposed, axially offset small-diameter outlet flow openings 98*a*, 98*b*, 100*a*, 100*b*, 102*a*, 102*b*, 104*a* and 104*b* are located short distances towards the flow opening 82 from the intermediate openings 96. Small openings 98*a*, 98*b* are midway between respective pairs of large openings 94*c*, 94*d* and 94*a*, 94*b* but are shifted axially from the intermediate openings 96 slightly less than about one-half diameter of the openings 96. Small openings 100*a*, 100*b* are adjacent respective large openings 94*d*, 94*b* but are shifted axially from the small openings 98 slightly more than about one-half diameter of the openings 98. Small openings 102*a*, 102*b* are adjacent respective large openings 94*c*, 94*a* but are shifted axially from the small openings 100 slightly more than about one-half diameter of the openings 100. Small openings 104*a*, 104*b* are adjacent respective intermediate openings 96*a*, 96*b* but are shifted axially from the small openings 102 slightly more than about one-half diameter of the openings 102. Furthermore, the two holes of each pair of openings 96, 98, 100, 102, 104 are axially shifted a small amount in opposite directions from each other.

The pairs of small openings 98, 100, 102, 104 are spaced around the wall 78 such that each opening has two circumferentially adjacent small openings that are axially shifted from such opening by different distances or in different axial directions from each other.

Axial movement of the spool 54 along the bore passage 52 regulates the flow of oil through the inlet throttle valve to the high-pressure pump 34. The position of the spool in the bore and thereby the flow of oil through the inlet throttle valve are determined by a pressure balance on the ends of the spool. The pilot fluid in chamber 62 urges the spool to the left as viewed in FIG. 3. Spring 66 and the internal pressure in chamber 60 urge, the spool to the right. The spool acquires an equilibrium position along the bore wherein the axial forces acting on the spool are balanced against each other.

Vent passage communicates the chamber 60 with sump 18. The sump 18 is maintained at a substantially constant pressure of between atmospheric pressure and about 2 psig. This enables the internal pressure within chamber 60 to remain essentially constant despite movement of the spool in the bore. The pressure in chamber 60 applies a constant force against the spool while the force applied by the spring 66 varies with the position of the spool.

Figure 7:
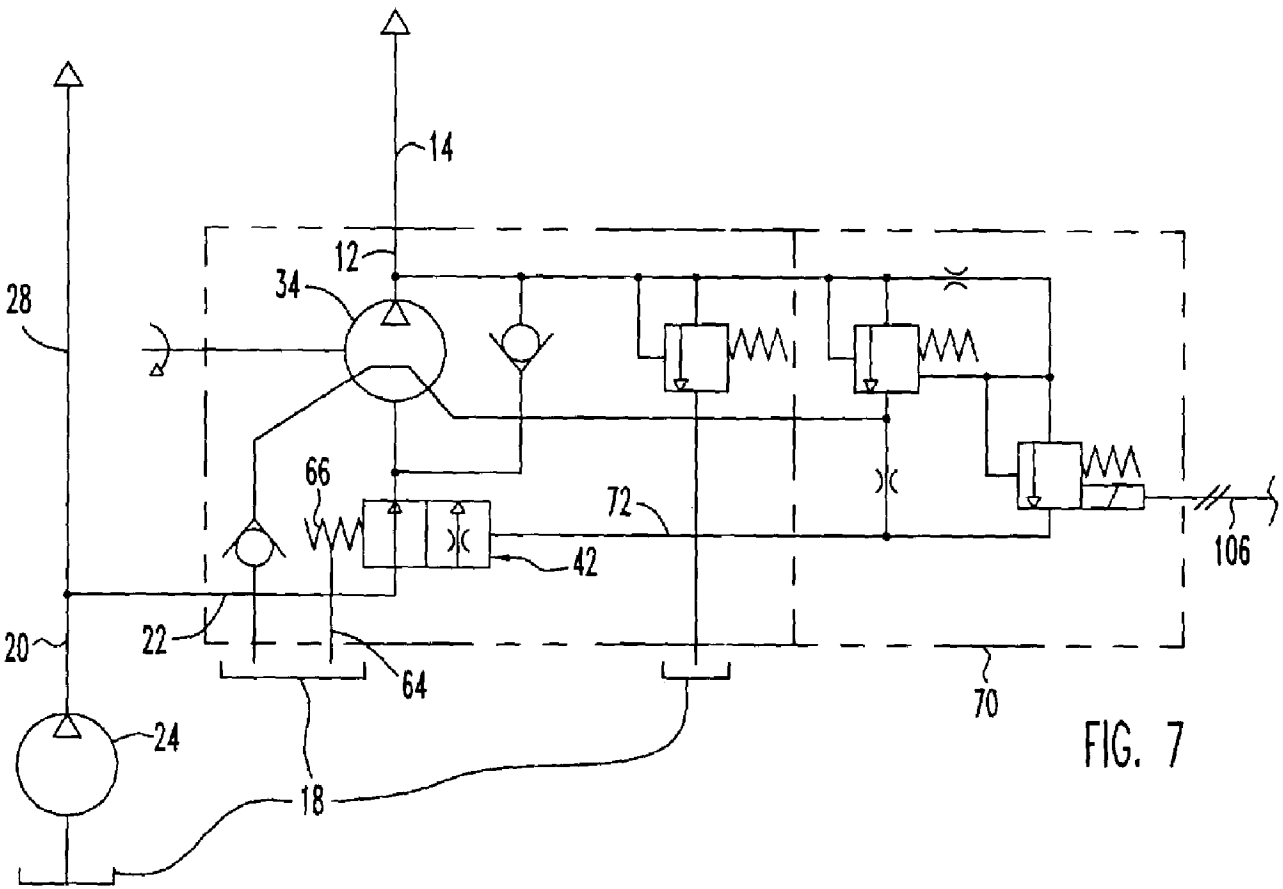
FIG. 7 is a diagram of the hydraulic circuitry of the pump assembly shown in FIG. 1.

FIG. 7 illustrates the hydraulic circuitry of pump assembly 10. The IPR valve 70 is an electrically modulated, two stage relief valve. The components of IPR valve 70 are shown in the dashed rectangle to the right of the figure, and the remaining components of pump assembly 10 are shown in the dashed rectangle to the left of the figure. The IPR valve and the remaining assembly components are identical to those disclosed in incorporated U.S. Pat. No. 6,460,510 and so will not be discussed in further detail.

IPR valve 70 controls the quantity and pressure of pilot fluid flowed into or out of the chamber 62 and thereby controls the position of the spool 54 along the bore 52. The IPR valve 70 is controlled by an engine electronic control module (not shown) that transmits a control signal 106 to the IPR valve. The signal 106 represents the desired instantaneous pressure output from the high-pressure pump 34. The IPR valve 70 controls the flow of pilot fluid to provide output flow from high-pressure pump 34 so that output pressure matches desired pressure. As seen in FIG. 7, pilot fluid flows from the output line 12, through the IPR valve 70, and through control passage 72 into valve chamber 62.

The pressure of the oil flowing through the spool 54 has no substantial impact on the equilibrium position of the spool along bore 52. The spool 54 acts essentially as a pressure vessel whose internal surfaces oppose the pressure of the oil within the vessel. The oil pressure within the spool generates no substantial net axial force on the spool because the forces acting on the end plugs are essentially equal in magnitude but opposite in direction, and therefore balance and cancel each other out. This allows the pressure of the low-pressure oil entering inlet port 22 to fluctuate without affecting the axial position of the spool along bore 52.

Furthermore, the spool inlet and outlet openings 82, 84 extend radially through the spool wall 70 so that axial forces are not generated. Internal flow of oil from the spool inlet opening 82 to the spool outlet opening 84 exerts a small axial force against the closed end 76 of the spool urging the spool toward the spring 66, but this force is negligible in comparison to the spring force.

The opposed pairs of spool outlet passages 96–104 also reduce net radial forces and resulting side loading and friction or hysteresis on the spool as the spool moves back and forth in bore 52. Each of the opposed pairs of passages are either open or closed except when passing the edge of valve annular opening 92. The diametral opposition of the slightly axially offset pairs of openings effectively balances radial pressure forces and reduces binding or hysteresis during spool movement. Reduction of binding or hysteresis assures that the spool moves freely and rapidly along the bore in response to a force differential across the ends of the spool. The annular valve openings 90, 92 completely surround spool 54 and help reduce hysteresis. The circumferentially spaced and opposed large diameter flow openings 82*a*–82*d* and 94*a*–94*d* also help reduce hysteresis.

The diameter of bore 52 in the illustrated inlet throttle valve 42 is 0.75 inches. The spool 54 has an axial length of about 3.54 inches and a cylindrical wall thickness of about 0.06 inches. The spool inlet openings 84*a*–*d* are each about 0.312 inches in diameter. The large diameter spool outlet openings 94 are each about 0.312 inches in diameter, the intermediate diameter spool openings 96 are each about 0.125 inches in diameter, and the small diameter spool openings 98–104 are each, about 0.094 inches in diameter.

Spool large-diameter outlet openings 94 are axially spaced centerline-to-centerline about 1.1 inches from spool inlet openings 84. Intermediate-diameter outlet openings 96 are axially shifted from spool openings 94 by about 0.162 inches. Spool openings 96 are axially shifted from spool openings 94 by about 0.05 inches, spool openings 98 from spool openings 100 by about 0.05 inches, spool openings 102 from spool openings 100 by about 0.05 inches, and spool openings 104 from spool openings 102 by about 0.05 inches. Furthermore, the openings of each pair of spool openings 96, 98, 100, 102, 104 are axially shifted about 0.0125 inches in opposite directions from each other and so are axially spaced about 0.025 inches from each other.

The size, cross-section area, cross-section shape, spacing and orientation of the spool inlet flow opening 82 and spool outlet flow opening 84 can be modified from the illustrated embodiment to meet design requirements and the viscosity of the fluid flowed through the spool 54. It is preferred however, that the inlet and outlet openings be designed to minimize side forces and hysteresis as previously described.

Operation of inlet throttled pump assembly 10 will now be described. Inlet throttle controlled pump assembly 10 flows the required volume of engine oil into manifold 14 to meet injector requirements throughout the operating range of the diesel engine.

The engine electronic control module (ECM) receives input signals from various sensors representing the operating condition of the engine, the pressure in the injector line 14, and the depression of the operator's accelerator pedal. The ECM determines the desired instantaneous pressure within the injector line 14 needed for optimum engine performance based on these input signals. Pressure within injector line 14 is controlled by varying the flow of oil discharged from high-pressure pump 34. The ECM sends control signal 106 to IPR valve 70 representing the desired instantaneous output from high-pressure pump 34.

IPR valve 70 controls the output of high-pressure pump 34 by selectively positioning spool 54 in bore passage 52 in response to the control signal. The operation details of the IPR valve 70 are discussed in detail in incorporated U.S. Pat. No. 6,460,510 and so are not repeated here. Summarizing, IPR valve 70 flows pilot fluid into or out of valve chamber 62 to control the axial position of the spool 54. Oil discharged from the pump 34 is used as pilot fluid, and flows from the output line 12, through the IPR valve 70, and through control passage 72 to valve chamber 62 to selectively position the spool 54 in bore 52. Axial movement of the spool 54 valves the flow of oil through inlet throttle valve 42 and thereby regulates the output of high-pressure pump 34.

Figure 3:
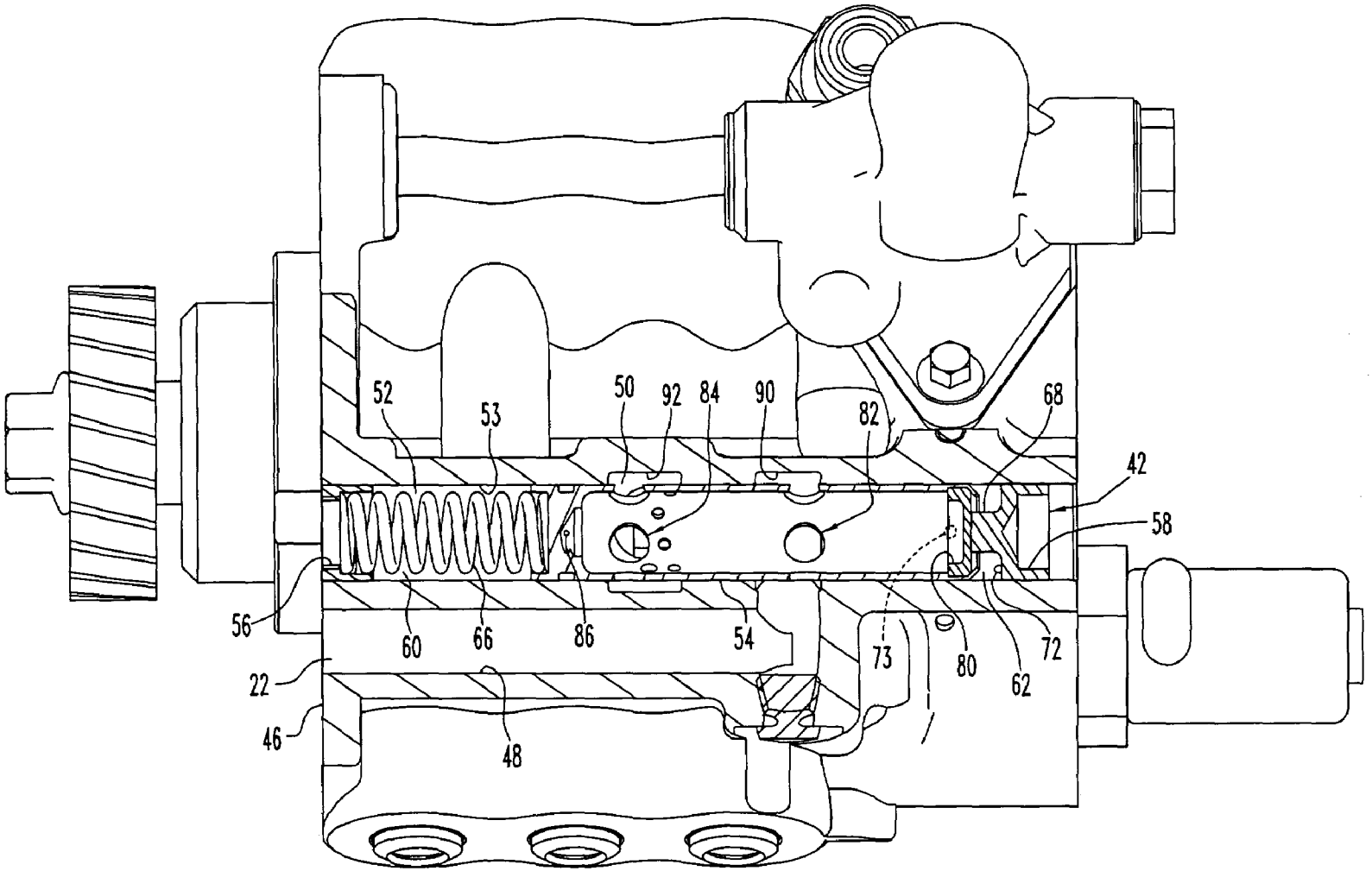
FIG. 3 is a sectional view taken along lines 3—3 of FIG. 2.
Figure 4:
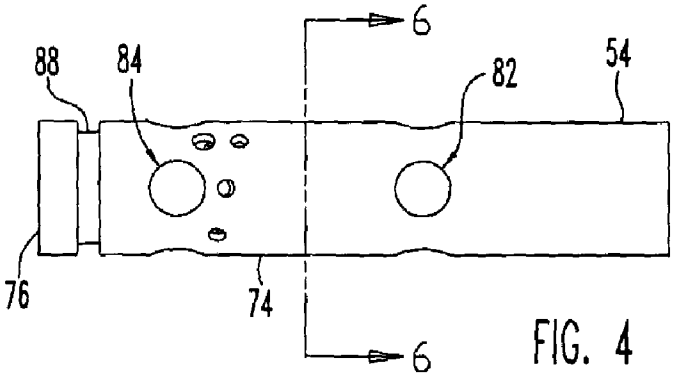
FIG. 4 is a side view of the inlet throttle valve spool shown in FIG. 3.

When the engine is shut off valve spool 54 is held in its fully open position as shown in FIG. 3, and spool outlet openings 94–102 are fully open. Pilot fluid pressure in chamber 62 is at a minimum and spring 66 presses the spool against the standoff 68. Chamber 60 is at its maximum volume and chamber 62 is at its minimum volume. Pilot drain port 73 is closed by spool wall 78.

During starting of the diesel engine an electric starter rotates the crank shaft of the engine and drives high-pressure pump 34 via input gear 30 relatively slowly. In order for the engine to start it is necessary for pump 34 to provide flow to increase the pressure of oil in the flow passage 14 to a sufficiently high level to fire the injectors 16, despite the slow rotational speed and corresponding limited capacity of pump 34.

At startup the inlet throttle valve is fully open. The spool inlet openings 82*a*–82*d* are fully open and flow oil from the annular valve passage 90 into the spool 54. The spool outlet openings 94–102 are fully open and flow oil out of the spool 54 to the annular valve passage 92. Flow openings 104 are to one side of wall opening 92 and are closed by bore wall 53. Oil from the feed oil pump 24 flows with minimum obstruction through the inlet throttle valve 42 to the pump 34 and is pumped into passage 14.

The rotation speed of the diesel engine increases when the engine starts, thereby increasing the flow of oil discharged by the pump 34. When oil pressure reaches a desired level, IPR valve 70 flows oil into chamber 62 to shift the spool 54 to the left from its fully open position to an operating position where large-diameter spool outlet openings 94 are closed.

Pilot pressure fluid in chamber 62 overcomes the opposing spring force and the pressure in chamber 60, and spool 54 moves away from the standoff 68. During closing movement of the spool from its fully open position, the spool outlet opening 84 progressively moves out of registration with the valve passage 92 and reduce the area of the spool opening 84 flowing oil to the high-pressure pump. The spool inlet opening 82 remains fully open, with the inlet openings 82*a*–82*d* fully facing the valve passage 90 throughout the operating range of spool 54. In an alternative embodiment both the spool inlet and spool outlet openings move out of registration with valve inlet 90 and valve outlet 92 and simultaneously reduce the areas of spool inlet opening 82 and spool outlet opening 84. In another alternative embodiment the spool inlet opening 82 moves out of registration with the valve inlet 90 to valve flow through the inlet opening 82 while the spool outlet opening 84 remains fully open.

During initial closing movement of the spool 54, flow openings 94 move past the valve outlet 92 and are rapidly closed. Closing movement serially closes flow openings 98, 100 and 102, and partially closes flow openings 104, progressively reducing the area of spool outlet 84 flowing oil to the pump 34. The overlapping positions of the outlet flow openings 94–104 assures that the spool outlet 84 reduces or closes smoothly without abrupt changes in flow. Similarly, the configuration of the outlet flow openings 94–104 assures that the spool outlet 84 increases or opens smoothly when the spool moves towards its full-open position.

Further closing movement passes the end of the spool past pilot drain port 73, uncovering the port. The port 73 now flows pilot flow from chamber 62 to the pump 34, draining chamber 62 and stopping the build up of pilot pressure in chamber 62. This stops the spool at its left-most closed position. Only one of the small spool outlet openings 104 is partially open at this point to allow minimum flow through the pump 34 for cooling and lubrication.

When the diesel engine is running pump assembly 10 controls the position of spool 54 in response to the ECM signal. The size and spacing of the spool inlet openings 82 and spool outlet openings 94–104 minimize hysteresis as previously described, enabling the spool to respond quickly and accurately throughout its operating range. The ability of spool 54 to tolerate fluctuations in inlet oil pressure without changing axial position eliminates the ECM from responding to these pressure fluctuations. This increases the control accuracy and operating stability of the system.

Furthermore, provisions to minimize fluctuations in output pressure from low-pressure feed pump 24 are not required.

During some engine operating conditions high-pressure pump 34 creates suction at the valve annular passage 92. When the spool is near its right-most position, pump suction attempts to draw air from sump 18, through vent passage 64 and chamber 60 to passage 92, and then to the pump 34. To resist air intake, pump suction flows oil from the interior of spool 54 through bleed line 86 and into spool reservoir 88.

The oil in reservoir 88 seals passage 92 from chamber 60, preventing air from being sucked into the pump. A small amount of oil may flow from the reservoir to passage 92 and lubricates spool 54 in bore 52.

Figure 8:
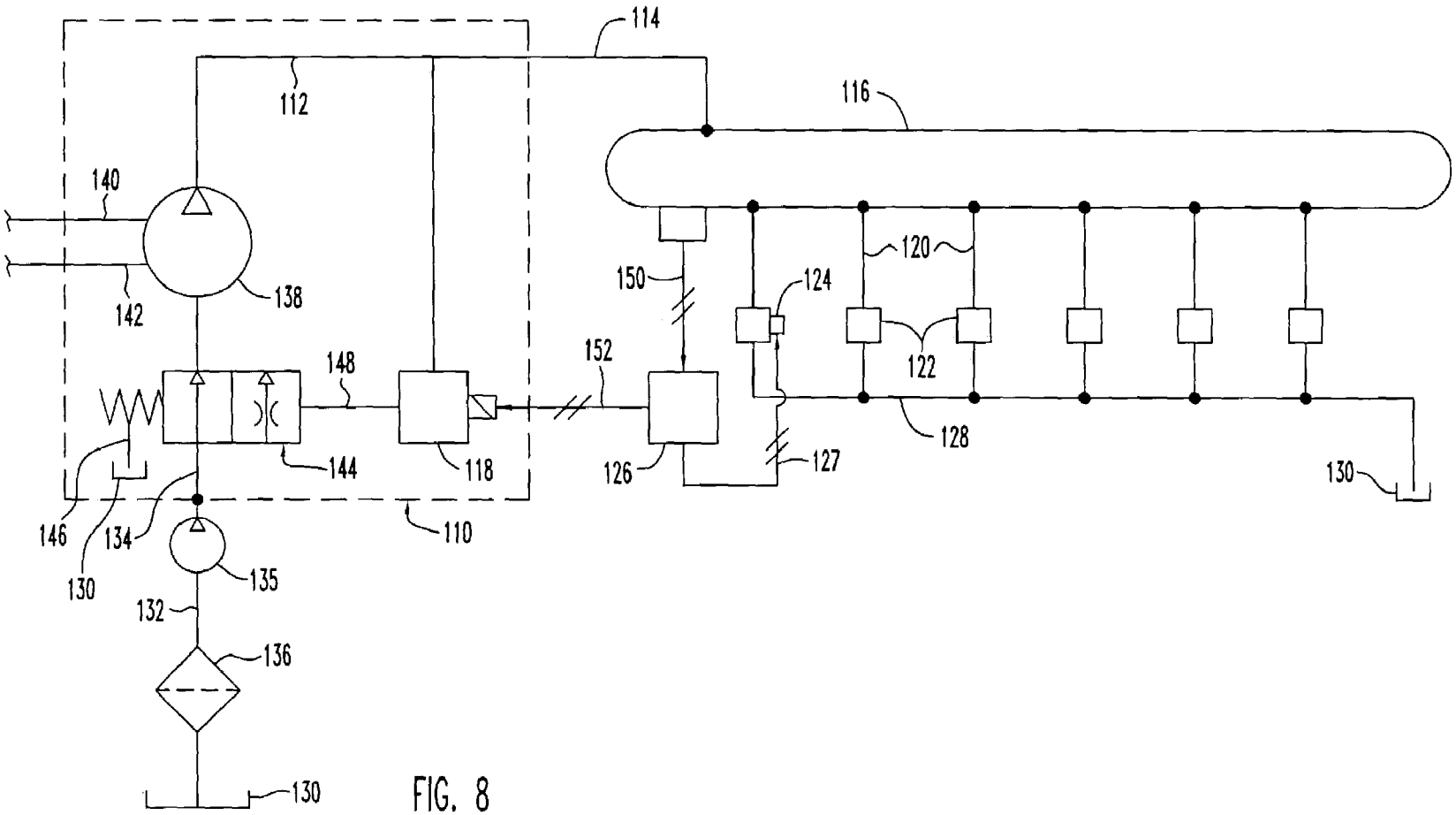
FIG. 8 is a representational view illustrating a second embodiment pump assembly mounted on a diesel engine to pressurize a common rail fuel injection system.

FIG. 8 schematically represents a second embodiment inlet throttle controlled pump assembly 110 mounted on a diesel engine used to power a motor vehicle. Pump assembly 110 forms part of a common rail fuel injection system.

Pump assembly 110 discharges high-pressure fuel through fuel outlet port 112 to a high-pressure fuel line 114 that supplies a common rail 116. Injector pressure relief valve or IPR valve 118 regulates the pressure in rail 116. Fuel supply lines 120 flow fuel from rail 116 to a number of fuel injectors 122. Each fuel injector 122 is opened or closed by an electronic actuator 124 under the control of electronic control module (ECM) 126 via an actuator signal 127 (for clarity only one actuator 124 and actuator signal 127 is shown). Fuel leakage from the injectors 122 returns via fuel return line 128 to a fuel tank 130.

Low-pressure diesel fuel is supplied to pump assembly 110 from fuel tank 130 through fuel inlet line 132 connected to pump assembly inlet port 134. The inlet line 132 includes a low-pressure fuel pump 135 that draws fuel from the fuel tank 130 through fuel filter 136. Fuel pump 135 may be mechanically driven by the engine or electrically driven.

High-pressure fuel pump 138 is connected between assembly inlet and outlet ports. The pump 138 is similar to high-pressure pump 34 but is lubricated by engine oil supply and return lines 140, 142. Pilot-operated inlet throttle valve 144, similar to inlet throttle valve 44, controls the flow of fuel into the pump 138. The pilot fluid is engine fuel and the spring chamber is vented to the fuel tank 130 by vent passage 146. The position of the inlet throttle valve spool is controlled by IPR valve 118 flowing pilot fluid through control passage 148 to the inlet throttle valve as previously described. IPR valve 118 can be a two-stage valve like IPR valve 70 or can be a single stage valve.

Operation of pump assembly 110 will now be described. Pump assembly 110 flows the required volume of engine fuel into rail 116 to meet injector requirements throughout the operating range of the diesel engine. Pressure within rail 116 is controlled by varying the flow of fuel discharged from high-pressure fuel pump 138.

ECM 126 determines the desired instantaneous pressure within common rail 116 needed for optimum engine performance. ECM 126 receives a signal 150 representing the fuel pressure discharged by high-pressure pump 138 and sends a control signal 152 to IPR valve 118 representing the desired instantaneous output from high-pressure pump 138. IPR valve 118 controls the output of high-pressure pump 138 by selectively positioning the inlet throttle valve spool in response to the control signal as previously described for pump assembly 10. The spool and spool flow openings are similar to those in inlet throttle 44 but are sized and configured to flow diesel fuel rather than lubricating oil and to meet the operating pressure and flow demands of the fuel injectors 122 during operation of the diesel engine.

High-pressure fuel pump 138 is sized to discharge fuel at a sufficiently high pressure that fuel is injected directly into the engine from the rail 116 without further pressurization. Maximum rail pressure, in one embodiment, is about 25,000 pounds per square inch. Alternatively, the high-pressure fuel pump 138 pressurizes the fuel at below injection pressure and the injectors 122 further pressurize the fuel to injection pressure when actuated. In yet other embodiments the injectors 122 can be hydraulically actuated by fuel discharged from high-pressure fuel pump 138.

Pump assemblies 10 and 110 are useful in pressurizing fluids and controlling fluid flow in fuel injection systems in diesel engines. The pump assemblies operate independently of fluctuations in supply pressure and provide improved engine efficiency and fuel economy and reduced vehicle emissions. The illustrated embodiments pressurize lubricating oil to actuate hydraulic fuel injection injectors and pressurize engine fuel supplied to a common rail. Each assembly may, however, be used in different applications to regulate the output of a fixed or variable displacement, high-pressure pump or be used to pressurize other working fluids. The inlet throttle valve spool could be adjusted manually or by another type of automatic controller.

While we have illustrated and described preferred embodiments of our invention, it is understood that these are capable of modification, and we therefore do not wish to be limited to the precise details set forth, but desire to avail ourselves of such changes and alterations as fall within the purview of the following claims.

We claim:

1. A system for regulating the flow of working fluid to a high-pressure pump that supplies pressurized working fluid for a fuel injection system of an internal combustion engine, the system comprising:

a body, an inlet throttle valve in the body, an inlet passage in fluid communication with the inlet throttle valve to flow low-pressure working fluid to the valve, an outlet passage in fluid communication with the inlet throttle valve to flow working fluid from the inlet throttle valve to the pump, a control passage to communicate pilot fluid to the inlet throttle valve for controlling fluid flow through the valve, a spring biasing the inlet throttle valve to an operating position, and control means for automatically controlling the flow of pilot fluid through the control passage in response to a signal representing the desired position of the valve;

the inlet throttle valve comprising a bore in the body extending along an axis, the bore having axially opposed first and second ends, a wall extending between the ends, a spool in the bore, the spool axially movable along the bore to regulate the flow of fluid through the valve, and a chamber in the bore between the spool and the first end of the bore;

the spool comprising axially opposed closed ends and a cylindrical wall extending between the ends, and inlet and outlet openings extending through the spool wall for flowing working fluid into and out of the spool;

the inlet passage comprising a first opening in the bore wall in registration with the spool inlet opening to flow working fluid from the inlet passage into the spool;

the outlet passage comprising a second opening in the bore wall in registration with the spool outlet opening to flow working fluid from the spool into the outlet passage;

the control passage opening into the chamber, the control passage configured to flow pilot fluid into and out of the chamber; and the spring biasing the spool towards the first end of the bore;

wherein the position of the spool in the bore and thereby the flow of working fluid through the inlet throttle valve are determined by a pressure balance between the spring and the pilot fluid in the chamber independently of the pressure of the working fluid.

2. The system as in claim 1 wherein the chamber is a first chamber and the inlet throttle valve comprises:

a second chamber adjacent the second end of the bore; and the inlet passage opening and the outlet passage opening are between the first and second chambers.

3. The system as in claim 2 wherein the spring is captured in the second chamber.

4. The system as in claim 2 wherein the inlet throttle valve comprises a vent passage fluidly connected from the second chamber to a substantially constant pressure source to maintain a substantially constant internal pressure within the second chamber.

5. The system as in claim 2 wherein the inlet passage is fluidly connected to a sump that is the source of the working fluid, and the vent passage is fluidly connected to the second chamber and the sump.

6. The system as in claim 2 comprising at least one bleed line flowing from the interior of the spool to an opening on the outside surface of the spool, the bleed line opening located between the second chamber and the discharge passage opening.

7. The system as in claim 6 comprising an annular groove formed on the outside of the spool, each bleed line opening in the groove.

8. The system as in claim 1 wherein the inlet passage opening and the outlet passage opening are axially spaced from each other along the bore wall.

9. The system as in claim 8 wherein one or both of the inlet passage opening and the outlet passage opening surrounds the bore.

10. The system as in claim 1 wherein the spool inlet and spool outlet openings are axially spaced from each other.

11. The system as in claim 10 wherein at least one of the spool inlet and outlet openings comprises a plurality of openings.

12. The system as in claim 11 wherein the plurality of openings are spaced around the spool and include a first set of large openings adjacent one end of the spool and a second set of small openings axially spaced from the large openings.

13. The system as in claim 11 wherein the plurality of openings comprises pairs of diametrically opposed openings.

14. The system as in claim 11 wherein the plurality of openings comprises a first set of openings and a second set of openings axially spaced from the first set of openings.

15. The system as in claim 1 wherein the spool outlet is movable into and out of registration with the outlet passage opening or the spool inlet is movable into and out of registration with the inlet passage opening to increase or decrease the flow of working fluid through the valve.

16. The system as in claim 15 wherein the spool outlet is movable into and out of registration with the outlet passage opening and the spool inlet remains in registration with the inlet passage opening throughout the range of movement of the spool.

17. The system as in claim 1 comprising a stop located between the spool and the control passage to limit axial movement of the spool toward the control passage and thereby prevent closing the control passage by the spool.

18. The system as in claim 1 wherein the inlet passage comprises an additional bore in the body, the additional bore having a length substantially parallel with the inlet throttle valve bore.

19. The system as in claim 1 wherein the working fluid comprises engine fuel or lubricating oil and the pilot fluid comprises engine fuel or lubricating oil.

20. The system as in claim 1 comprising a low-pressure pump fluidly connected to the inlet passage upstream of the inlet throttle valve.

21. The system as in claim 1 wherein the spool is axially movable between a first operating position and a second operating position and the inlet throttle valve comprises a pilot drain port to drain pilot fluid out of the compartment, the pilot drain port comprising a third opening in the bore wall, movement of the spool opening and closing the third opening wherein the spool closes the third opening when the spool is in the first position and the third opening is open when the spool is in the second position to establish the second position of the spool.

22. The system as in claim 1 wherein the outlet passage is fluidly connected to a plurality of hydraulically actuated fuel injectors or to a common rail.

23. A pilot-controlled inlet throttle valve assembly for controlling the flow of working fluid to a high-pressure pump pressurizing the working fluid of a fuel injection system of a motor vehicle engine, the assembly comprising:

a body, an inlet throttle valve in the body, an inlet passage to flow working fluid to the inlet throttle valve, an outlet passage to discharge working fluid from the inlet throttle valve to the pump, and a fluid circuit to communicate a pilot fluid to the inlet throttle valve and selectively operate the valve in response to the pilot fluid pressure;

the inlet throttle valve comprising a bore in the body, the bore having axially spaced first and second ends, a wall extending between the ends, a hollow piston in the bore, the piston slideable in the bore to control the flow of fluid through the valve, a chamber in the bore between the piston and the first end of the bore, and a spring biasing the piston towards the chamber;

the fluid circuit opening into the chamber, the fluid circuit configured to flow pilot fluid into and out of the chamber for controlling the position of the piston along the bore;

the inlet passage comprising a first opening in the bore wall and the outlet passage comprising a second opening in the bore wall;

the piston comprising axially opposed closed ends, an outer surface surrounding the interior of the piston, and a flow passage extending through the interior of the piston between the ends of the piston, the flow passage in fluid communication with the first and second openings to flow working fluid through the inlet throttle valve, and a valving edge opening and closing the flow passage with movement of the piston;

wherein the position of the piston along the bore is established by a pressure balance between the spring and the pilot pressure in the chamber and is substantially unaffected by pressure fluctuations in the working fluid flowing through the valve.

24. The inlet throttle valve assembly of claim 23 wherein the flow passage comprises first and second piston openings, each piston opening extending from the outer surface of the piston to the interior of the piston, the first piston opening facing the first wall opening and the second piston opening facing the second wall opening to flow working fluid through the valve assembly.

25. The inlet throttle valve assembly of claim 24 wherein the valving edge surrounds one or both of the first and second piston openings.

26. The inlet throttle valve assembly of claim 24 wherein the first and second wall openings are axially spaced from each other.

27. The inlet throttle valve assembly of claim 26 wherein the first and second piston openings are axially spaced from each other;

the first piston opening comprises a plurality of openings spaced around the piston; and the second piston opening comprises a plurality of openings spaced around the piston.

28. The inlet throttle valve assembly of claim 27 wherein at least one of the said plurality of openings comprises a plurality of larger diameter openings and a plurality of smaller diameter openings.

29. The inlet throttle valve assembly of claim 28 wherein the larger diameter openings are axially spaced from the smaller diameter openings.

30. The inlet throttle valve assembly of claim 23 wherein the inlet passage is fluidly connected to a low-pressure pump upstream of the inlet throttle valve.

31. The inlet throttle valve assembly as in claim 30 wherein the low-pressure pump has an operating speed and the discharge pressure of the low-pressure pump fluctuates with changes in operating speed.

32. The inlet throttle valve assembly of claim 23 wherein the position of the piston along the bore is controlled by an engine control module.

33. The inlet throttle valve assembly of claim 23 wherein the inlet throttle valve comprises a hydraulic stop that opens to flow pilot fluid out of the chamber when the piston reaches a predetermined position along the bore.

34. The inlet throttle valve assembly of claim 23 wherein the chamber is a first chamber at one end of the piston and the inlet throttle valve comprises a second chamber at the other end of the piston, the second chamber containing the spring.

35. The inlet throttle valve assembly of claim 34 wherein the second chamber is fluidly connected to an essentially constant pressure source wherein the internal pressure of the second chamber is independent of the axial position of the piston.

36. The inlet throttle valve assembly of claim 23 wherein the outlet passage of the inlet throttle valve is fluidly connected to at least one of a hydraulically-actuated fuel injector and a common rail.

37. A method of regulating the flow of working fluid to a high-pressure pump in a fuel injection system of an internal combustion engine, the method comprising the steps of:

(a) providing an inlet throttle valve and a fluid passage from the inlet throttle valve to the pump, the inlet throttle valve comprising a flow passage to flow fluid through the inlet throttle valve to the fluid passage and a hollow piston in the flow passage, the piston comprising two closed ends, a piston wall extending between the ends and obstructing the flow passage, and an opening extending through the piston wall to flow fluid past the obstruction;

(b) flowing working fluid through the flow passage to flow fluid through the inlet throttle valve and to the high-pressure pump, this step comprising flowing working fluid in the flow passage through the opening and into the piston and flowing working fluid in the piston through the opening and out of the piston to flow the working fluid past the obstruction;

(c) generating a signal representing the desired instantaneous rate of flow of working fluid discharged from the pump; and (d) moving the piston to open or close the opening in response to the signal to control the output of working fluid discharged from the inlet throttle valve and flowed to the pump.

38. The method of claim 37 wherein the opening comprises separate inlet and openings in the piston wall.

39. The method of claim 38 wherein the piston is movable along a longitudinal axis and the inlet and outlet openings extend radially through the thickness of the piston wall.

40. The method of claim 38 wherein the inlet and outlet openings are axially offset from one another.

41. The method of claim 37 wherein the piston is movable in a bore, the piston dividing the bore into first and second chambers, each chamber on an opposite end of the piston, and step (d) comprises the step of:

(e) flowing pilot fluid into the first chamber to move the valve member in a first direction axially along the bore.

42. The method of claim 41 wherein step (d) comprises the step of:

(f) continuously urging the piston to move in a second direction opposite the first direction; and (g) draining pilot fluid from the first chamber to move the piston in the second direction.

43. The method of claim 41 wherein the piston is movable in the first direction to an operating position and step (d) comprises the step of:

(f) draining pilot fluid from the first compartment in response to the piston reaching the operating position and therein limiting axial movement of the valve member in the first direction.

44. The method of claim 41 including the step of:

(f) maintaining a substantially uniform pressure in the second chamber during operation of the inlet throttle valve.

45. The method of claim 37 wherein step (b) comprises the step of:

(e) fluctuating the pressure of the working fluid flowing through the inlet throttle valve.

* * * * *